US009960500B2

(12) United States Patent
Song et al.

(10) Patent No.: US 9,960,500 B2
(45) Date of Patent: May 1, 2018

(54) COMPACT ANTENNA ARRAY USING VIRTUAL ROTATION OF RADIATING VECTORS

(71) Applicant: Quintel Technology Limited, Bristol (GB)

(72) Inventors: Peter Chun Teck Song, San Francisco, CA (US); David Edwin Barker, Stockport (GB)

(73) Assignee: Quintel Technology Limited, Bristol (GB)

( * ) Notice: Subject to any disclaimer, the term of this patent is extended or adjusted under 35 U.S.C. 154(b) by 370 days.

(21) Appl. No.: 14/659,123

(22) Filed: Mar. 16, 2015

(65) Prior Publication Data

US 2015/0263435 A1 Sep. 17, 2015

Related U.S. Application Data

(60) Provisional application No. 61/954,344, filed on Mar. 17, 2014.

(51) Int. Cl.
*H01Q 21/26* (2006.01)
*H01Q 21/24* (2006.01)
*H01Q 21/06* (2006.01)

(52) U.S. Cl.
CPC ..... *H01Q 21/245* (2013.01); *H01Q 21/062* (2013.01); *H01Q 21/26* (2013.01)

(58) Field of Classification Search
CPC ..... H01Q 21/245; H01Q 21/062; H01Q 21/26
USPC ..... 343/810
See application file for complete search history.

(56) References Cited

U.S. PATENT DOCUMENTS

| | | | | |
|---|---|---|---|---|
| 5,966,102 | A | 10/1999 | Runyon | |
| 6,211,841 | B1 | 4/2001 | Smith et al. | |
| 6,480,168 | B1 | 11/2002 | Lam et al. | |
| 7,663,544 | B2 | 2/2010 | Thomas et al. | |
| 8,879,997 | B2 | 11/2014 | Barker | |
| 2003/0137464 | A1* | 7/2003 | Foti | H01P 1/161 343/770 |
| 2006/0114168 | A1 | 6/2006 | Gottl et al. | |

(Continued)

FOREIGN PATENT DOCUMENTS

| | | |
|---|---|---|
| CN | 103 545 621 A | 1/2014 |
| CN | 103 560 338 A | 2/2014 |
| EP | 2 736 117 A1 | 5/2014 |

OTHER PUBLICATIONS

International Search Report and Written Opinion of PCT/US2015/020781, dated Sep. 2, 2015, pp. 1-13.

(Continued)

*Primary Examiner* — Andrea Lindgren Baltzell

(57) ABSTRACT

In one example, a device includes an antenna array having at least a first cross dipole antenna element having a first dipole and a second dipole orthogonal to the first dipole and at least a second cross dipole antenna element having a third dipole and a fourth dipole orthogonal to the third dipole. An orientation of the at least a second cross dipole antenna is offset 45 degrees with respect to the at least a first cross dipole antenna element. The at least a first cross dipole antenna element and the at least a second cross dipole antenna element are for transmitting and/or receiving signals at plus 45 degrees and minus 45 degrees slant polarizations.

23 Claims, 5 Drawing Sheets

(56) References Cited

U.S. PATENT DOCUMENTS

| | | | | |
|---|---|---|---|---|
| 2012/0280879 | A1 | 11/2012 | Zimmerman et al. | |
| 2014/0139387 | A1* | 5/2014 | Jones | H01Q 21/30 343/794 |

OTHER PUBLICATIONS

Extended European Search Report for corresponding EP Patent Application No. 15765512.7 dated Nov. 27, 2017. 8 Pages.

* cited by examiner

100

400

COMPACT ANTENNA ARRAY USING VIRTUAL ROTATION OF RADIATING VECTORS

CROSS-REFERENCE TO RELATED APPLICATIONS

This application claims priority to U.S. Provisional Patent Application Ser. No. 61/954,344, filed Mar. 17, 2014, which is herein incorporated by reference in its entirety.

FIELD OF THE DISCLOSURE

The present disclosure relates generally to cross-polarized antenna arrays.

BACKGROUND

Cellular mobile operators are using more spectrum bands and increasingly more spectrum within each band in order to satisfy growing subscriber traffic demands, and for the deployment of new radio access technologies, e.g., Long Term Evolution (LTE) and LTE-Advanced radio access technology.

SUMMARY

In one illustrative embodiment, a device includes an antenna array having at least one first cross dipole antenna element having a first dipole and a second dipole orthogonal to the first dipole, and at least one second cross dipole antenna element having a third dipole and a fourth dipole orthogonal to the third dipole. An orientation of the at least one second cross dipole antenna is offset 45 degrees with respect to the at least one first cross dipole antenna element. The at least one first cross dipole antenna element and the at least one second cross dipole antenna element are for transmitting and/or receiving signals at plus 45 degrees and minus 45 degrees slant polarizations. The at least one second cross dipole antenna element is an adjacent antenna element to the at least one first cross dipole antenna element.

In an additional illustrative embodiment, a method for using an antenna array includes: receiving a first signal for transmission at a first 45 degree slant linear polarization and receiving a second signal for transmission at a second 45 degree slant linear polarization. The second 45 degree slant linear polarization is orthogonal to the first 45 degree slant linear polarization. The method may further include: driving a first dipole of at least one first cross-dipole antenna element of the antenna array with the first signal, driving a second dipole of the at least one first cross-dipole antenna element of the antenna array with the second signal, splitting the first signal into a first co-phased component signal and a second co-phased component signal, splitting the second component signal into a first anti-phased component signal and a second anti-phased component signal, driving at least one dipole of a first polarization state with the first co-phased component signal and the first anti-phased component signal, and driving at least one dipole of a second polarization state with the second co-phased component signal and the second anti-phased component signal. In one example, the at least one dipole of the first polarization state and the at least one dipole of the second polarization state are components of at least one second cross-dipole antenna element of the antenna array.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
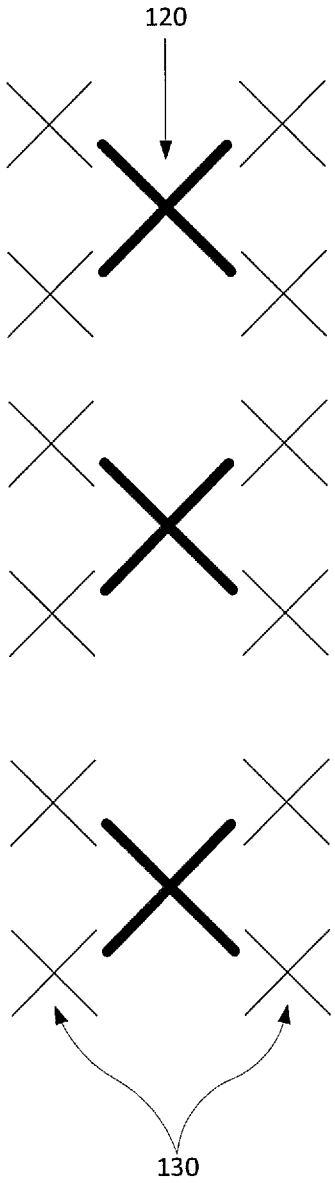
FIG. 1 depicts a portion of an antenna array having sub-arrays for different frequency bands.

Cellular mobile operators are using more spectrum bands and increasingly more spectrum within each band in order to satisfy growing subscriber traffic demands, and for the deployment of new radio access technologies, e.g., Long Term Evolution (LTE) and LTE-Advanced radio access technology. Cellular sites therefore may need base station antenna solutions which can support multiple spectrum bands. Most cellular operators who have multiple bands may group these into low-band spectrum bands and high-band spectrum bands. For instance, in Europe, the 800 MHz and 900 MHz bands can be classed as low-band spectrum bands, whereas 1800 MHz, 2100 MHz and 2600 MHz can be classed as high-band spectrum bands.

Cellular networks may use a variety of base station and antenna solutions depending upon the physical environment, the radio channel environment, radio frequency (RF) power, service coverage and capacity requirements. Base station sites can be classified into for example, macro-cell, micro-cell, small cell, indoor cell, Distributed Antenna System (DAS), etc. Macro-cell sites are designed for wider area coverage and typically have sectorized panel antenna arrays with a directive main beam to obtain necessary gain, and which are located above the average height of the surrounding buildings.

The base station antenna may consist of a stack of radiating elements that are arranged vertically via a linear configuration over a length of the reflector plane. For example, each element radiates a dual orthogonal polarization field where the polarization is in the +45 and −45 degrees orientation due to the effects of the propagation environment, giving a more symmetric attenuation compared to horizontal and vertical polarization. This also provides balanced diversity branches which are optimal for combining at the receiver.

To enable multiple services from a single antenna enclosure typically with a single reflector plane, multiple stacks of antenna arrays operating at both low and high band frequencies will have to be co-located within this space. In some cases the side by side configurations are realized, where the low band (LB) element sits in the center of the reflector plane, and the additional two high-band (HB) array stacks of HB elements are located on both sides of the LB dipole. Due to this arrangement, the reflector plane width of the antenna may have to be broadened to accommodate these elements. This broadening is to reduce the mutual coupling effects between the elements that will detune the antenna and result in poorer radiated performance.

These base station antennas can be mounted on cellular towers where the base station antennas are subjected to high winds. This implies a mechanical integrity requirement of the antenna mounting, and the tower. The wind loading effects are worst when the surface area of the antenna is increased. Due to this reason, the width of the antenna may be kept at a minimal. However, this may indirectly increase the mutual coupling of the antenna elements, which may result in poorer radiated performance.

The present disclosure relates generally to more efficient packing of antenna elements in an antenna array, and more particularly, with respect to devices and systems for transmitting and receiving signals at a particular polarization using a plurality of antenna elements that are oriented in one or more different configurations. Embodiments of the present disclosure increase the packing density of the antenna array stacks where the width of the antenna can be kept to a minimum, without deteriorating antenna performance, or increasing the wind loading effects. As used herein, the terms "antenna" and "antenna array" are used interchangeably. In addition, for consistency, and unless otherwise specifically noted, with respect to any of the antenna arrays depicted the real-world horizon is indicated as left-to-right/right-to-left on the page, and the up/vertical direction is in a direction from the bottom of the page to the top of the page.

In an antenna array for cellular applications, each antenna element in the array may be a dual-polarized crossed dipole at +45/−45 degrees (for the effective radiating vectors). Some antenna arrays have low and high band elements together in a single array. For example, there may be two sub-arrays side by side in a single array. For example, FIG. 1 shows an antenna array 100 having a low band (LB) sub-array 120 and two high band (HB) sub-arrays 130. However, when there are LB and HB antenna elements together in one array, there is a packing density issue. For example, the antenna array 100 of FIG. 1, takes up a large amount of space. It is possible to place the antenna elements from the LB sub-array 120 and the HB sub-arrays 130 close together. However, the result is partial blocking, obstruction or "shadowing" by LB elements over HB elements. Undesirable consequences when there is such overlapping also include mutual coupling, blocking and detune effects, which makes the array harder to design and to control. One implementation may use cross-polarized antenna arrays with linear +45/−45 degree slant oriented antenna elements because this results in having balanced propagation and radio channel characteristics which provides diversity power balance, and optimal diversity combining performance.

Figure 2A:
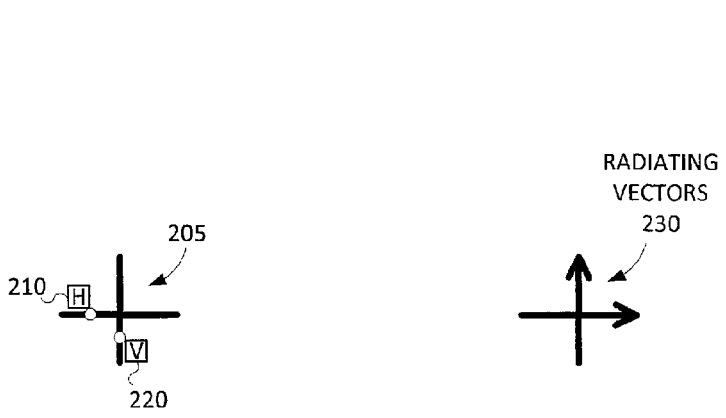
FIG. 2A depicts a horizontal and vertical oriented cross dipole antenna element and its effective radiating vectors.

For a typical dual-polarized horizontal and vertical (H/V) oriented cross dipole antenna element, the radiating vectors having the same orientations as the cross dipoles (also referred to as "radiating elements") of the antenna element. This is shown in FIG. 2A. In particular, FIG. 2A shows a dual-polarized cross dipole antenna element 205 having a horizontal dipole 210 and a vertical dipole 220. The effective radiating vectors 230 are shown adjacent to the antenna element 205. The radiating vectors 230 may result in undesirable transmission characteristics, as discussed earlier. In contrast to the foregoing, examples of the present disclosure use virtual rotation of radiating vectors to transmit (and receive) signals at the +45/−45 degrees slant polarizations, while using horizontal and vertical oriented cross-dipole antenna elements. Specifically, instead of physically orienting cross dipoles as +45/−45 degrees, at least one cross dipole antenna element is physically oriented with its dipoles horizontally and vertically (H/V) orientated, while the communication signals transmitted and received via the at least one cross dipole antenna element are virtually rotated to the polarizations of +45/−45 degrees. Examples of the present disclosure provide a greater packing density of antenna elements than otherwise achievable by using antenna elements that are oriented at both +45/−45 degrees and at H/V orientations. In addition, examples of the present disclosure enable the use of two different antenna arrays for different frequency bands, e.g., a low-frequency band, or LB, and a high-frequency band, or HB. In particular, some or all of the antenna elements of one or both of the frequency bands have a H/V orientation and other antenna elements have a +45/−45 degrees orientation.

Figure 2B:
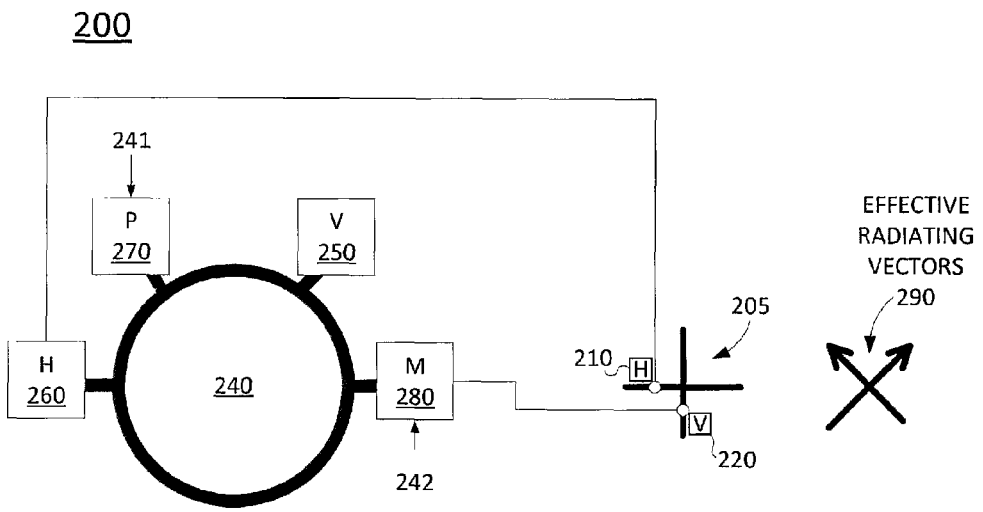
FIG. 2B depicts a first device for rotating the effective radiating vectors from a cross dipole antenna element.

A first example device 200 is shown in FIG. 2B. Device 200 includes a H/V oriented dual-polarized cross dipole antenna element 205 having a horizontal dipole 210 and a vertical dipole 220 that are oriented orthogonally to each other. Device 200 also includes a circuit, or power divider 240 for rotating, or controlling the effective radiating vectors 290 of dual-polarized antenna element 205. In one example, the power divider 240 comprises a hybrid coupler or a (180 degree) hybrid ring coupler, such as a rat-race coupler. As shown in FIG. 2B, power divider 240 includes two input ports (assuming connection to signals intended for transmission), designated as positive 'P' input port 270 (also referred to as an in-phase input) and minus 'M' input port 280 (also referred to herein as an out-of-phase input) and two output ports, designated as 'V' output port 250 and 'H' output port 260.

For example, the signals 241 and 242 input at positive 'P' input port 270 and minus 'M' input port 280 respectively may be for transmission at +45 and −45 degree linear slant polarization, respectively. To illustrate this, consider the signal 241 which is input at the positive input port 270, which enters the power divider 240, which in this case is a 180-degree hybrid ring coupler, splits power equally into two branches with one branch traveling clockwise to output port 'V' labeled 250 and the other branch traveling counterclockwise to output port 'H' labeled 260. Notably, the distance between the positive input port 270 and the 'H' port 260 and the distance between the positive input port 270 and the 'V' port 250 are the same distance. In one example, this distance is at or substantially close to a distance that is the equivalent of 90 degrees of phase for a center frequency within a frequency band of the signals to be transmitted and received via the device 200.

In any case, since the signal 241 received at input port 270 travels the same distance, the two output ports 250 and 260 receive identical signals of the same power and same phase (e.g., these are two "co-phased" component signals). Similarly, the signal 242 received at minus input port 280 enters the power divider 240, splits power equally into two branches with a branch traveling clockwise and a branch travelling counterclockwise. Notably, the distance between the minus input port 280 and the 'V' port 250 is the same distance as between the positive input port 270 and the 'V' output port 250, for instance, a distance that provides for 90 degrees of phase shift. Thus, the signal 242 from the minus input port 280 arrives as the 'V' output port 250 having a same phase as the signal 241 on the positive input port 270. However, in one example, the distance between the minus input port 280 and the 'H' output port 260 is three times the distance between the minus input port 280 and the 'V' port 250. For instance, this distance may be a distance or length that provides for 270 degrees of phase shift, e.g., for a signal at a center frequency of a desired frequency band. In other words, when the signal 242 from the minus input port 280 arrives at the 'H' port 260, it is 180 degrees out of phase with respect to the signal 241 that arrives at the 'H' output port 260 from the positive input terminal 270. In addition, since the signal 241 received at input port 280 travels a different distance to the two output ports 250 and 260, the output ports receive signals of the same power but 180-degrees out-of-phase (e.g., these are two "anti-phased" component signals).

As described above, the 'H' output port 260 and the 'V' output port 250 receive the signals 241 and 242 from both the positive input port 270 and minus input port 280. These signals are combined at the respective output ports 250 and 260, and are forwarded to the horizontal dipole 210 and vertical dipole 220 respectively for RF transmission. If the signals on positive input port 270 and minus input port 280 were connected directly to the antenna element 205, the resulting radiating vectors would appear as shown in FIG. 2A, i.e., radiating vectors 230. However, due to the signal delays and power dividing that are imparted through power divider 240, the resulting radiating vectors from antenna element 205 appear as shown in FIG. 2B, i.e., radiating vectors 290 which have +45/−45 degree slant linear polarizations.

Figure 4:
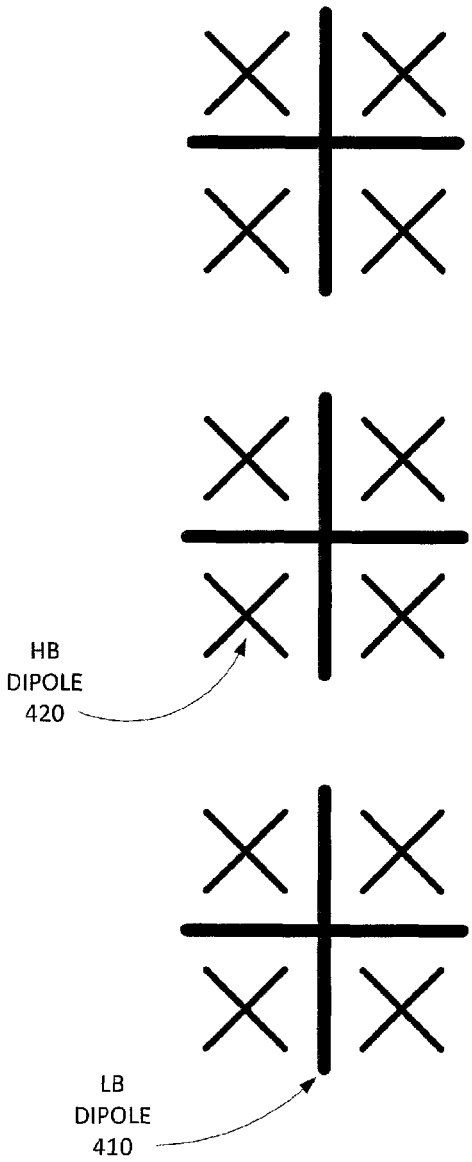
FIG. 4 depicts a first antenna assembly having sub-arrays for different frequency bands.
Figure 5:
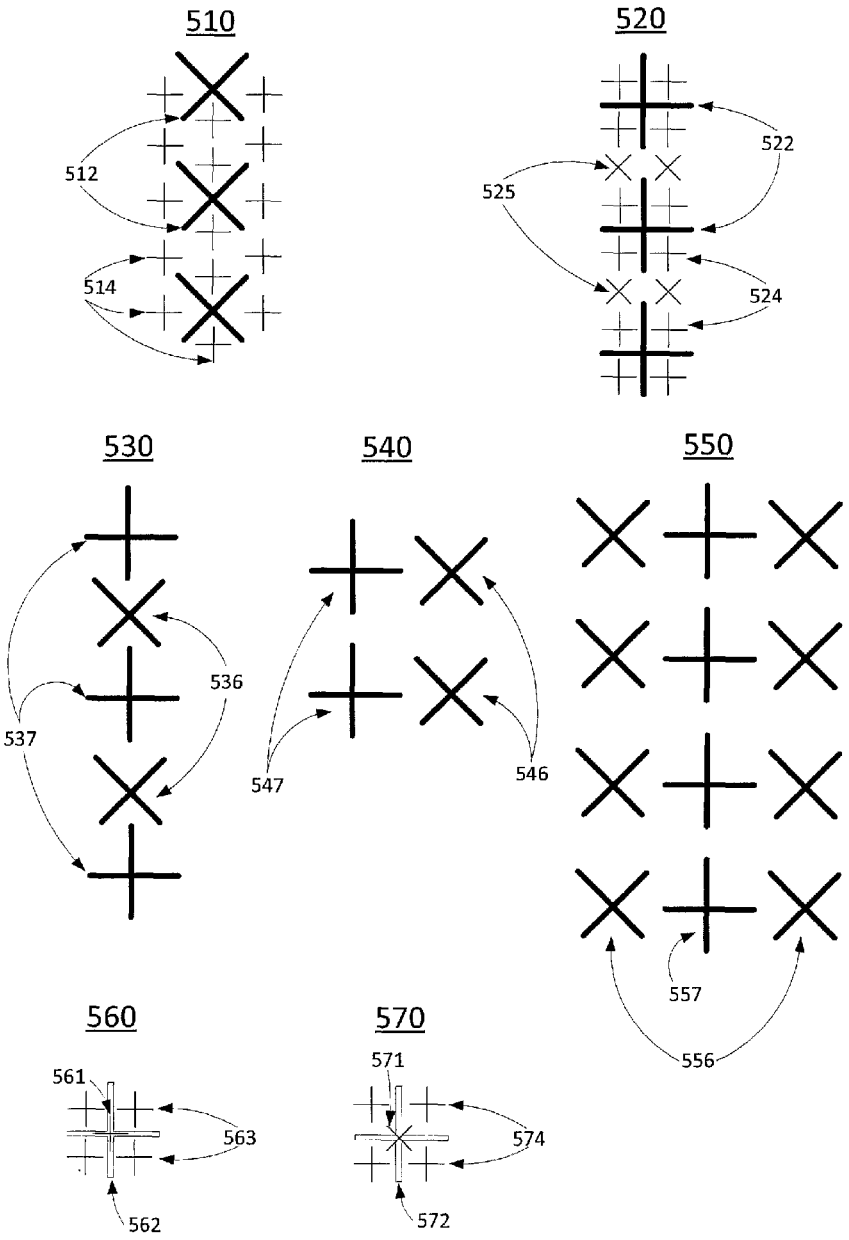
FIG. 5 depicts several examples of antenna arrays according to the present disclosure.

Advantageously, the device 200 allows the use of a H/V oriented dual-polarized cross dipole antenna element, e.g., antenna element 205, while providing for the +45/−45 degree slant linear polarization effective radiating vectors that would be provided by a typical +45/−45 degree oriented cross dipole antenna element. This polarization vector rotation allows for various novel antenna array layouts that would not otherwise be achievable without significant performance compromises. To illustrate, FIGS. 4 and 5 show several example antenna array layouts, or designs according to the present disclosure.

It should be noted that examples of the present disclosure describe the use of +45/−45 degree linear slant polarizations or H/V linear polarizations. However, although linear polarization is typical, and examples are given using linear polarizations, other embodiments of the present disclosure can be readily arrived at, for example including dual-orthogonal elliptical polarization, or left hand circular and right hand circular polarizations, as will be appreciated by those skilled in the art. In addition, although a passive power divider comprising a 180 degree hybrid ring coupler and/or a rat race coupler is described in various examples herein, the present disclosure is not so limited. For example, the present disclosure may broadly employ various circuits capable of providing relatively phase shifted signals, and therefore resulting in the rotation of effective radiating vectors of one or more dual-polarized cross-dipole antenna elements. For instance, such circuits may include passive RF devices, such as 90 degree hybrid couplers, active RF components or devices, devices that include processes or algorithms implemented in software and/or digital signal processing (DSP) devices, e.g., a software process with associated active components, and so forth.

Figure 3:
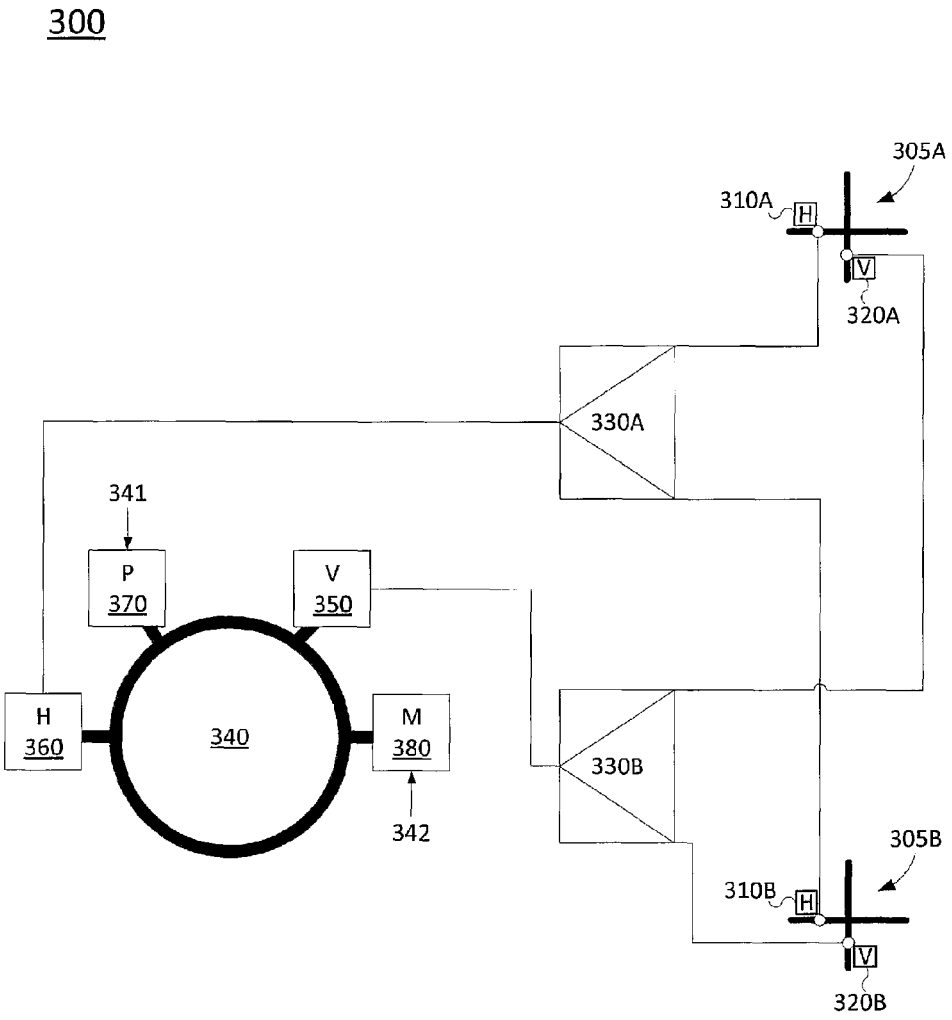
FIG. 3 depicts a second device for rotating the effective radiating vectors from an antenna having a plurality of cross dipole antenna elements.

FIG. 3 illustrates a device 300 for rotating the effective radiating vectors from an antenna having a plurality of dual-polarized cross dipole antenna elements, in accordance with the present disclosure. Device 300 is substantially similar to device 200; however it includes a plurality of antenna elements. For example, as shown in FIG. 3, there is a first dual-polarized H/V oriented cross dipole antenna element 305A having a horizontal dipole 310A and a vertical dipole 320A, and a second dual-polarized H/V oriented cross dipole antenna element 305B having a horizontal dipole 310B and a vertical dipole 320B. Although only two elements are shown, those skilled in the art will appreciate that an array with additional antenna elements, e.g., up to ten or more, can be realized with a larger distribution network comprising a greater number of splitters/power dividers and so forth. For instance, for practical directivity gains for a cellular base station antenna, this may comprise many elements, e.g., 5-14 elements, depending upon the spectrum band of operation and desired directivity and resulting vertical plane or elevation pattern beamwidth. In this regard, it should be noted that although linear antenna arrays are typical, examples of the present disclosure are applicable to both linear and non-linear.

As illustrated in FIG. 3, Device 300 also includes a power divider/circuit 340 having a positive input port 370 for receiving an input signal 341 for transmission (e.g., broadly interpreted as obtaining, collecting or connecting to a signal, e.g., as part of a signal processing process where the signal will be transmitted) at +45 degrees linear slant polarization, a minus input port 380 for receiving an input signal 341 for transmission at −45 degrees linear slant polarization, a 'V' output port 350 and a 'H' output port 360. Power divider 340 functions the same or substantially similar to power divider 240 in FIG. 2B. The output ports 350 and 360 are connected to splitter/combiners 330A and 330B. Splitter/combiner 330A is connected to the respective horizontal dipoles 310A and 310B, while splitter/combiner 330B is connected to the respective vertical dipoles 320A and 320B. As with device 200, device 300 also provides effective radiating vectors from each of the H/V oriented cross dipole antenna elements 305A and 305B that are at +45/−45 degree linear slant polarizations. It should be noted that in FIGS. 2B and 3, for illustrative purposes only, the 'V' output ports are connected to vertical dipoles and the 'H' output ports are connected to horizontal dipoles. In addition, FIGS. 2B and 3 are described in connection with the transmission of positive and minus input signals. However, those skilled in the art will appreciate that the devices 200 and 300 will function in a reciprocal manner for receiving signals at +45/−45 degree linear slant polarizations.

FIGS. 2B and 3 illustrate devices which are able to transmit signals at a particular polarization using antenna elements that are oriented in a particular configuration. In other words, to transmit at +45/−45 degree linear slant polarizations using antenna elements/cross dipoles having H/V orientations. FIGS. 4 and 5 extend the present disclosure to example antenna arrays in which the antenna elements are efficiently packed, and which are used in conjunction with a device, such as device 300 of FIG. 3, for rotating the effective radiating vectors for transmission and reception.

As mentioned above, some applications call for the use of an antenna array having antenna elements for use with two (or more) different frequency bands. For illustrative purposes, the present disclosure will broadly refer to a low frequency band, or LB, and a high frequency band, or HB. For instance, in Europe, the 800 MHz and 900 MHz bands may be classed as low-band spectrum bands, whereas 1800 MHz, 2100 MHz and 2600 MHz may be classed as high-band spectrum bands. However, it should be understood that the present disclosure is not limited to any particular frequencies or frequency ranges and that the mentioning of any specific values are for illustrative purposes only.

It should be noted that throughout the examples of FIGS. 4 and 5, for purposes of clarity only, certain antenna elements are specifically indicated with reference numbers. However, antenna elements of the same type (e.g., HB or LB) are indicated by the same size and shape throughout FIGS. 4 and 5.

FIG. 4 show a first antenna array 400 that includes LB dual-polarized antenna elements 410 and HB dual-polarized antenna elements 420. Notably, the LB antenna elements 410 are oriented horizontally and vertically (H/V) whereas the HB antenna elements 420 are oriented at +45/−45 degrees. In this arrangement, the HB antenna elements 420 can be situated closer to the LB antenna elements 410 that would be achievable if the LB antenna elements 410 were oriented at +45/−45 degrees. For example, the antenna array 400 of FIG. 4 advantageously occupies less horizontal space than the antenna array 100 of FIG. 1.

As mentioned above, the antenna array 400 may be used in conjunction with a circuit or device such as shown in FIG. 3. To illustrate, the plurality of LB antenna elements 410 having H/V orientations may be connected to a device such as device 300 of FIG. 3 for transmitting and receiving signals at +45 and −45 polarizations. In contrast, the plurality of HB antenna elements 420 may be connected to a conventional antenna array distribution network, i.e., the signals intended for transmission and reception by these HB elements do not pass through a circuit/device such as device 300. In this way, signals in either the low frequency band or high frequency band that are intended for transmission/reception at +45/−45 degree polarizations can be transmitted/received with such polarization states, regardless of the physical orientation of the antenna element(s) through which the signals are transmitted/received.

FIG. 5 illustrates several further examples of antenna arrays according to the present disclosure. In particular, antenna arrays 510 and 520 each include mixed HB and LB sub-arrays comprising HB antenna elements and LB antenna elements respectively. In antenna array 510, the LB antenna elements 512 are oriented at +45/−45 degrees whereas the HB antenna elements 514 have horizontal and vertical (H/V) orientation. For antenna array 510, the HB antenna elements 514 may each be connected to one or more circuits/devices such as device 300 in order to provide transmission and reception of signals that will be virtually rotated such that the signals will be transmitted/received with +45/−45 degree slant linear polarizations using the H/V oriented HB antenna elements (514). In contrast, LB antenna elements 512 may receive and transmit signals via conventional means, i.e., the reception and transmission of signals do not pass through a circuit/device such as device 300.

Antenna array 520 includes LB antenna elements 522 with H/V orientation whereas some of the HB antenna elements 524 have H/V orientation and some of the HB antenna elements 525 have +45/−45 degree orientations. In this case, the LB antenna elements 522 may be connected to one or more devices, such as device 300, in order to virtually rotate signal polarizations for transmission and reception at +45/−45 degree slant linear polarizations. In one example, HB antenna elements 524 and 525 may be for transmission and reception of the same signals. However, HB antenna elements 524 may be connected to one or more other devices, such as device 300, to rotate the signals for transmission and reception at +45/−45 degree slant polarizations, whereas HB antenna elements 525 may receive and transmit the signals without such processing.

Examples of the present disclosure also provide antenna arrays for a single band, e.g., HB or LB only. For example, antenna array 530 includes only LB antenna elements, e.g., an in-line array. Some of the antenna elements 536 are oriented at +45/−45 degrees whereas others of the antenna elements 537 have H/V orientations. In one embodiment, the antenna elements 536 and 537 may, but need not be, for transmitting and receiving the same base signals. Thus, antenna elements 537 may be connected to one or more other devices, such as device 300, to rotate the polarization of the signals for transmission and reception at +45/−45 degree slant linear polarizations, whereas antenna elements 536 may receive and transmit the signals without such processing. Notably, antenna array 530 has a greater packing efficiency, i.e., it occupies less space than if all of the antenna elements were given +45/−45 degree orientations. Antenna arrays 540 and 550 provide additional examples of single band antenna arrays. For example, antenna array 540 includes +45/−45 degree oriented antenna elements 546 and H/V oriented antenna elements 547. Similarly, antenna array 550 includes +45/−45 degree oriented antenna elements 556 and H/V oriented antenna elements 557.

In some of the examples of FIG. 5, a center of the at least a first cross dipole antenna element is situated vertically above or below a center of the at least a second cross dipole antenna element in the antenna array, e.g., as in antenna arrays 510 and 530. Similarly, in some of the examples of FIG. 5, a center of the at least a first cross dipole antenna element is situated horizontally adjacent to a center the at least a second cross dipole antenna element in the antenna array, e.g., as in antenna arrays 510, 540, and 550. It should also be noted that all of the abovementioned examples of FIG. 5 (and the example of FIG. 4 as well), feature a second cross dipole antenna element that is adjacent to a first cross dipole antenna element, where an orientation of the second cross dipole antenna is offset 45 degrees with respect to the first cross dipole antenna element. For instance, in antenna array 530 each pair of adjacent antenna elements comprises a H/V oriented antenna element 537 and a +45/−45 degree oriented antenna element 536. Similarly, in antenna array 550, in each horizontal row only H/V oriented antenna elements 557 and +45/−45 degree oriented antenna elements 556 are adjacent. In other words, no two antenna elements having similar physical orientations are adjacent in any horizontal row.

Further example antenna arrays 560 and 570 are also provided in FIG. 5. Antenna arrays 560 and 570 illustrate that the present disclosure is not limited to packing arrangements in two dimensions, but can be used to achieve greater packing efficiencies using a third dimension. In particular, antenna array 560 includes dual-polarized H/V oriented LB antenna elements 562 with dual-polarized H/V oriented HB antenna elements 561 co-located in the same position. In other words, the centers of dual-polarized H/V oriented LB antenna elements 562 and the centers of dual-polarized H/V oriented HB antenna elements 561 occupy the same positions in the antenna array 560. This may be referred to as a "dual in-line" antenna arrangement. Two additional HB array stacks using HB antenna elements 563 are located on either side of the LB antenna elements 562.

The antenna array 570 includes dual-polarized H/V oriented LB antenna elements 572 with dual-polarized +45/−45 degree oriented HB antenna elements 571 co-located in the same position. In other words, the centers of dual-polarized H/V oriented LB antenna elements 572 and the centers of dual-polarized +45/−45 degree oriented HB antenna elements 571 occupy the same positions in the antenna array 570. This may also be similarly termed as a "dual in-line" antenna arrangement. HB antenna elements 574 of an additional two HB array stacks are located on either side of the LB elements 572.

While the foregoing describes various examples in accordance with one or more aspects of the present disclosure, other and further example(s) in accordance with the one or more aspects of the present disclosure may be devised without departing from the scope thereof, which is determined by the claim(s) that follow and equivalents thereof.

What is claimed is:

1. A device comprising:

an antenna array, comprising:

at least one first cross dipole antenna element having a first dipole and a second dipole orthogonal to the first dipole, wherein a length of the first dipole is the same as a length of the second dipole; and at least one second cross dipole antenna element having a third dipole and a fourth dipole orthogonal to the third dipole, wherein a length of the third dipole is the same as a length of the fourth dipole, wherein an orientation of the at least one second cross dipole antenna is offset 45 degrees with respect to the at least one first cross dipole antenna element, wherein the at least one first cross dipole antenna element and the at least one second cross dipole antenna element are for transmitting or receiving signals at +45 degrees and −45 degrees slant polarizations.

2. The device of claim 1, wherein the at least one second cross dipole antenna element is an adjacent antenna element to the at least one first cross dipole antenna element.

3. The device of claim 1, wherein the first dipole and the second dipole of the at least one first cross dipole antenna element are oriented horizontally and vertically, and wherein the third dipole and the fourth dipole of the at least one second cross dipole antenna element are oriented at +45 degrees and −45 degrees.

4. The device of claim 1, further comprising:

a circuit for rotating effective radiating dual-orthogonal polarization vectors that are transmitted or received by the at least one first cross dipole antenna element, wherein a first output terminal of the circuit is connected to the first dipole of the at least one first cross dipole antenna element, and wherein a second output terminal of the circuit is connected to the second dipole of the at least one first cross dipole antenna element.

5. The device of claim 4, wherein the circuit comprises one or more of:

a power divider;

a hybrid coupler;

a hybrid ring coupler;

a 180 degree hybrid ring coupler;

a 90 degree hybrid coupler;

a rat race coupler;

active radio frequency components; or a software process with associated active components.

6. The device of claim 4, wherein the effective radiating dual-orthogonal polarization vectors are one of:

orthogonal linear polarizations;

orthogonal elliptical polarizations; or orthogonal circular polarizations.

7. The device of claim 4, wherein the circuit is for rotating polarizations of the effective radiating dual-orthogonal polarization vectors by 45 degrees.

8. The device of claim 4, wherein the at least one first cross dipole antenna element comprises at least two cross dipole antenna elements, the device further comprising:

at least two splitter-combiners, wherein at least one first splitter-combiner of the at least two splitter-combiners is for at least one of splitting signals from and combining signals to the first output terminal, wherein at least one second splitter-combiner of the at least two splitter-combiners is for at least one of splitting signals from and combining signals to the second output terminal.

9. The device of any of claim 1, wherein the antenna array comprises antenna elements for at least two different frequency bands.

10. The device of claim 9, wherein the at least one first cross dipole antenna element is for a first frequency band of the at least two different frequency bands.

11. The device of claim 10, wherein the at least one second cross dipole antenna element is for a second frequency band of the at least two different frequency bands.

12. The device of claim 1, wherein a center of the at least one first cross dipole antenna element is situated vertically above or below a center of the at least one second cross dipole antenna element in the antenna array.

13. The device of claim 1, wherein a center of the at least one first cross dipole antenna element is situated horizontally adjacent to a center the at least one second cross dipole antenna element in the antenna array.

14. The device of claim 1, wherein a center of the at least one first cross dipole antenna element and a center of the at least one second cross dipole antenna element are co-located in a same position in the antenna array.

15. The device of claim 1, wherein the at least one first cross dipole antenna element is oriented such that a rotation of the orientation of the at least one first cross dipole antenna element by 45 degrees would result in an overlap, blocking or shadowing of the at least one second cross dipole antenna element.

16. The device of claim 1, wherein the at least one first cross dipole antenna element is oriented such that a rotation of the orientation of the at least one first cross dipole antenna element by 45 degrees would result in mutual coupling or detune effects between the at least one first cross dipole antenna element and the at least one second cross dipole antenna element.

17. A method for using an antenna array, comprising:

receiving a first signal for transmission at a first 45 degree slant linear polarization;

receiving a second signal for transmission at a second 45 degree slant linear polarization, wherein the second 45 degree slant linear polarization is orthogonal to the first 45 degree slant linear polarization;

driving a first dipole of at least one first cross dipole antenna element of the antenna array with the first signal;

driving a second dipole of the at least one first cross dipole antenna element with the second signal, wherein a length of the first dipole of at least one first cross dipole antenna element is the same as a length of the second dipole of the at least one first cross dipole antenna element;

splitting the first signal into a first co-phased component signal and a second co-phased component signal;

splitting the second component signal into a first anti-phased component signal and a second anti-phased component signal;

driving at least one dipole of a first polarization state with the first co-phased component signal and the first anti-phased component signal; and driving at least one dipole of a second polarization state with the second co-phased component signal and the second anti-phased component signal, wherein the at least one dipole of the first polarization state and the at least one dipole of the second polarization state are components of at least one second cross-dipole antenna element of the antenna array, wherein a length of the at least one dipole of the first polarization state is the same as a length of the at least one dipole of the second polarization state.

18. The method of claim 17, wherein the at least one second cross dipole antenna element is an adjacent antenna element to the at least one first cross dipole antenna element.

19. The method of claim 18, wherein the first dipole and the second dipole of the at least one first cross dipole antenna element are oriented horizontally and vertically, and wherein the third dipole and the fourth dipole of the at least one second cross dipole antenna element are oriented at +45 degrees and −45 degrees.

20. The method of claim 17, wherein the splitting the first signal into a first co-phased component signal and a second co-phased component signal and the splitting the second component signal into a first anti-phased component signal and a second anti-phased component signal are performed via a circuit having a first output terminal connected to the at least one dipole of the first polarization state, and a second output terminal connected to the at least one dipole of the second polarization state.

21. The method of claim 17, wherein a center of the at least one first cross dipole antenna element is situated vertically above or below a center of the at least one second cross dipole antenna element in the antenna array.

22. The method of claim 17, wherein a center of the at least one first cross dipole antenna element is situated horizontally adjacent to a center the at least one second cross dipole antenna element in the antenna array.

23. The method of claim 17, wherein a center of the at least one first cross dipole antenna element and a center of the at least one second cross dipole antenna element are co-located in a same position in the antenna array.

* * * * *